US008012658B2

(12) United States Patent
Nozaki et al.

(10) Patent No.: US 8,012,658 B2
(45) Date of Patent: Sep. 6, 2011

(54) TONER FOR DEVELOPING ELECTROSTATIC IMAGE, AND IMAGE FORMING APPARATUS AND PROCESS CARTRIDGE USING THE TONER

(75) Inventors: Chiyoshi Nozaki, Ootsu (JP); Takuya Kadota, Kobe (JP); Katsunori Kurose, Takarazuka (JP); Mitsuyo Matsumoto, Ibaraki (JP); Tsuyoshi Nozaki, Ikeda (JP); Yoshimichi Ishikawa, Itami (JP); Atsushi Yamamoto, Kawanishi (JP); Hiroyuki Murakami, Toyonaka (JP)

(73) Assignee: Ricoh Company Limited, Tokyo (JP)

( * ) Notice: Subject to any disclaimer, the term of this patent is extended or adjusted under 35 U.S.C. 154(b) by 701 days.

(21) Appl. No.: 12/026,057

(22) Filed: Feb. 5, 2008

(65) Prior Publication Data

US 2008/0220357 A1 Sep. 11, 2008

(30) Foreign Application Priority Data

Mar. 8, 2007 (JP) ..... 2007-058642

(51) Int. Cl.
*G03G 9/087* (2006.01)

(52) U.S. Cl. ..... 430/109.1; 430/108.1; 430/109.3; 430/109.4

(58) Field of Classification Search ..... 430/108.1, 430/109.1, 109.3, 109.4
See application file for complete search history.

(56) References Cited

U.S. PATENT DOCUMENTS

2005/0255398 A1* 11/2005 Hiraoka et al. ..... 430/109.4
2006/0204882 A1 9/2006 Nozaki et al.
2006/0210902 A1 9/2006 Nakamura et al.
2006/0275686 A1 12/2006 Kadota et al.
2006/0292473 A1* 12/2006 Kadokura et al. ..... 430/108.6
2007/0026335 A1 2/2007 Yamamoto et al.
2007/0059625 A1 3/2007 Yamamoto et al.
2007/0166635 A1 7/2007 Yamamoto et al.
2007/0190442 A1 8/2007 Nakamura et al.
2007/0207399 A1 9/2007 Kadota et al.
2007/0212630 A1 9/2007 Yasunaga et al.
2007/0217842 A1 9/2007 Kato et al.

(Continued)

FOREIGN PATENT DOCUMENTS

JP 07239573 * 9/1995

(Continued)

OTHER PUBLICATIONS

Abstract of JP 07239573, Sep. 1995.*

(Continued)

*Primary Examiner* — Hoa V Le
(74) *Attorney, Agent, or Firm* — Oblon, Spivak, McClelland, Maier & Neustadt, L.L.P.

(57) ABSTRACT

A toner including a binder resin including a polyester resin and a vinyl resin; a wax; and a colorant, wherein the vinyl resin includes a unit obtained from a radically polymerizable monomer having an alkyloxysilyl group. An image forming apparatus including an image bearing member configured to bear an electrostatic image thereon; a developing device configured to develop the electrostatic image with a developer including the toner to form a toner image on the image bearing member; and a transfer device configured to transfer the toner image onto a receiving material. A process cartridge including an image bearing member; and a developing device configured to develop an electrostatic image on the image bearing member with a developer including the toner, wherein the process cartridge is detachably attached to an image forming apparatus as a unit.

14 Claims, 2 Drawing Sheets

U.S. PATENT DOCUMENTS

| | | | |
|---|---|---|---|
| 2007/0218384 | A1 | 9/2007 | Matsumoto et al. |
| 2007/0218388 | A1 | 9/2007 | Kurose et al. |
| 2007/0218393 | A1 | 9/2007 | Nozaki et al. |
| 2007/0238042 | A1 | 10/2007 | Yasunaga et al. |

FOREIGN PATENT DOCUMENTS

| | | |
|---|---|---|
| JP | 2002-328489 | 11/2002 |
| JP | 2005-274615 | 10/2005 |

OTHER PUBLICATIONS

Machine English language translation of JP 07239573, Sep. 1995.*

U.S. Appl. No. 11/624,525, filed Jan. 18, 2007, Hideaki Yasunaga, et al.

* cited by examiner

TONER FOR DEVELOPING ELECTROSTATIC IMAGE, AND IMAGE FORMING APPARATUS AND PROCESS CARTRIDGE USING THE TONER

BACKGROUND OF THE INVENTION

1. Field of the Invention

The present invention relates to a toner for developing electrostatic images. In addition, the present invention also relates to an image forming apparatus and a process cartridge using the toner.

2. Discussion of the Background

Electrophotographic image forming apparatuses such as copiers, printers, facsimiles and multi-function printers have been broadly used because of being capable of recording images on various kinds of receiving materials at high speed.

In order to fulfill a need for an image forming apparatus capable of producing high quality images at higher speed, development has been made in various fields (such as machine, toner and photoreceptor fields).

In order to fulfill the need for high quality images, for example, toner having a small average particle diameter and a spherical form has to be used. In order to fulfill the need for high speed recording, for example, toner having a better fixability has to be used. Specifically, a need has been existing for a toner which has a spherical from, a small average particle diameter, a sharp particle diameter distribution, a sharp charge quantity distribution, and a good fixability.

On the other hand, kneading/pulverization methods have been used for preparing toner. It is hard for such kneading/pulverization methods to produce toner having a small average particle diameter and to control the particle form of toner. In addition, since it is hard for such kneading/pulverization methods to use resins, which cannot be well pulverized, as binder resins of the toner, it is difficult to produce toner having a good combination of fixability and pulverizability by kneading/pulverization methods. Therefore, in attempting to solve the problem, other toner preparation methods such as emulsion aggregation methods, and suspension polymerization methods have been developed. By using such toner preparation methods, toner having a small average particle diameter, a sharp particle diameter distribution and a sharp charge quantity distribution can be efficiently prepared.

Recently, the need for high speed recording is growing more and more. Therefore, a need exists for toner having a better combination of fixability and durability. Specifically, when the image forming speed of an image forming apparatus (particularly, the developing speed of a developing speed thereof) is increased, the stresses applied to the toner in the developing device increases, thereby causing a problem (a cracking problem) in that the particles of the toner are cracked or disintegrated by the stresses, resulting in formation of fine toner particles and production of abnormal images. Therefore, a need exists for toner having a good durability so as not to produce fine toner particles even when used for a long period of time.

In attempting to impart good fixability to toner, techniques in that polyester resins are used as binder resins have been proposed. This is because polyester resins have lower melt viscosity and higher elasticity than other resins such as styrene-acrylic resins and therefore the resultant toner has a good combination of low temperature fixability and high temperature preservability.

In attempting to develop a toner fulfilling the above-mentioned needs, published unexamined Japanese patent application No. (hereinafter referred to as JP-A) 2002-328489 discloses a toner preparation method in which a polymer prepared by using a monomer having a silicone atom or a fluorine atom and a polymer prepared by using a monomer having an acidic polar group are aggregated to prepare toner particles.

In addition, JP-A 2005-274615 discloses a toner in which the ratios of silicon atoms or fluorine atoms to carbon atoms in the surface portion and inner portion of the toner are specified so that the amount of silicon atoms or fluorine atoms included in the surface portion is greater than that in the inner portion. It is described therein that the surface of toner particles has a relatively low surface energy and therefore the toner can maintain a good reliability even when used for a long period of time.

However, as a result of the present inventors' investigation, it is found that the durability and reliability of these toners are not satisfactory for recent image forming apparatuses. In addition, it is also found that when emulsion aggregation methods are used and particles to be fused by heat to produce aggregated particles include a crosslinkable component, the crosslinkable component hinders fusion aggregation of the particles, and thereby the resultant toner particles have an unstable aggregated state. Therefore, when the toner is used, the above-mentioned cracking problem is caused. Thus, the long-term durability and reliability of a toner cannot be improved by merely decreasing the surface energy of the toner.

Because of these reasons, a need exists for a toner which has a good low-temperature fixability, and hardly causes an offset problem (in that a toner image is adhered to a fixing member, resulting in formation of abnormal images or jamming of a receiving sheet bearing an image thereon) even when used for image forming apparatus using an oil-less fixing device, or an image forming apparatus which can produce images at high speed without causing the offset problem.

SUMMARY OF THE INVENTION

As an aspect of the present invention, a toner is provided which includes a binder resin including a polyester resin and a vinyl resin, a wax and a colorant. The vinyl resin includes a unit having an alkyloxysilyl group. The vinyl resin includes a unit obtained from a radically polymerizable monomer having an alkyloxysilyl group.

It is preferable that the toner is prepared by an emulsion aggregation method, and the radically polymerizable monomer has the following formula (1).

$$CH_2{=}CR^1-(X)_k-(Y)_m-SiR^2_n(OR)_{3-n} \quad (1)$$

wherein R represents a linear or branched alkyl group having 1 to 6 carbon atoms; $R^1$ represents a hydrogen atom or a methyl group; $R^2$ represents an alkyl group having 1 to 3 carbon atoms; X represents a phenylene group, —COO—, or —CONH—; Y represents a linear or branched alkylene group having 1 to 6 carbon atoms; each of k and m is 0 or 1, wherein a case where both k and m are 0 is excluded; and n is 0, 1 or 2.

Another aspect of the present invention, an image forming apparatus is provided which includes an image bearing member configured to bear an electrostatic image thereon, a developing device configured to develop the electrostatic image with a developer including the toner mentioned above to form a toner image on the image bearing member, and a transfer device configured to transfer the toner image onto a receiving material.

Yet another aspect of the present invention, a process cartridge is provided which includes at least an image bearing member configured to bear an electrostatic image thereon, and a developing device configured to develop the electrostatic image with a developer including the toner mentioned above to form a toner image on the image bearing member, wherein the process cartridge is detachably attached to an image forming apparatus as a unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
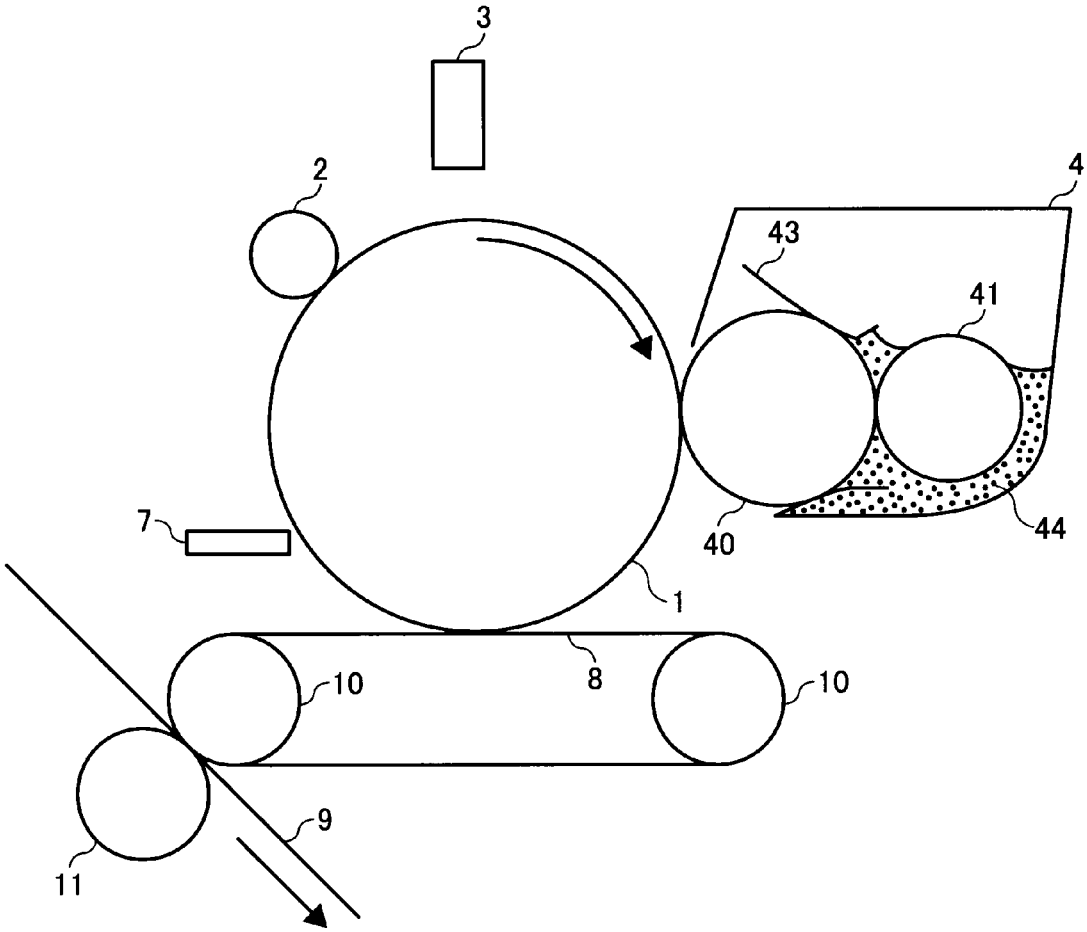
FIG. 1 is a schematic view illustrating an example of the image forming apparatus of the present invention.

At first, the toner of the present invention will be explained.

The toner of the present invention includes a binder resin including a polyester resin and a vinyl resin, a wax and a colorant. The vinyl resin includes a unit obtained from a radically polymerizable monomer having an alkyloxysilyl group. Specifically, the vinyl resin is prepared using a radically polymerizable monomer having an alkyloxysilyl group.

It is preferable that the toner is prepared by an emulsion aggregation method which includes the following steps:

(1) subjecting a colorant, a wax, a binder resin including a polyester resin and a vinyl resin prepared using a radically polymerizable monomer having an alkyloxysilyl group to an emulsion aggregation treatment (i.e., a heat/fusion treatment) in an aqueous phase to prepare an aqueous dispersion including aggregated particles including the colorant, wax and binder resin;

(2) then changing the silanol to a siloxane by a method including heating the dispersion, a method including controlling the pH of the dispersion, or the like method; and (3) crosslinking the siloxane to prepare toner particles.

In the step (1), the vinyl resin in the dispersion includes no crosslinkable component, and therefore the aggregation treatment can be stably performed without obstruction. Since a crosslinkable component (i.e., siloxane) is prepared in the step (2), the binder resin can be crosslinked (step (3)). Thus, a toner having a good durability (i.e., a good resistance to cracking (or pulverization) and disintegrating) can be provided.

Next, the constituents of the toner of the present invention will be explained in detail.

Binder Resin

Vinyl Resin Including Unit Obtained from Monomer Having Alkyloxysilyl Group

The vinyl resin is not particularly limited, and any vinyl resins can be used therefor as long as the resins include a unit obtained from a radically polymerizable monomer having an alkyloxysilyl group. In addition, combinations of plural kinds of vinyl resins including a unit obtained from a monomer having an alkyloxysilyl group can also be used. The weight average molecular weight of the vinyl resins is preferably not greater than 50,000, and more preferably not greater than 30,000. When the weight average molecular weight is too large, the low temperature fixability of the toner deteriorates. The glass transition temperature (Tg) of the vinyl resins is preferably from 40 to 80° C., and more preferably from 50 to 70° C. When the Tg is too high, the low temperature fixability of the toner deteriorates. In contrast, when the Tg is too low, the high temperature preservability of the toner deteriorates.

Specific examples of the radically polymerizable monomers for use in preparing the vinyl resins include p-styryltrimethoxysilane, 3-methacryloyloxypropylmethyldimethoxysilane, 3-methacryloyloxypropyltrimethoxysilane, 3-methacryloyloxypropylmethyldiethoxysilane, 3-methacryloyloxypropyltriethoxysilane, 3-acryloyloxypropyltrimethoxysilane, 3-methacryloyloxypropylmethyldipropoxysilane, 3-methacryloyloxypropylmethyldiisopropoxysilane, 3-methacryloyloxypropyldimethylhexyloxysilane, 3-methacryloylaminopropyltrimethoxysilane, etc., but are not limited thereto as long as the monomers have the following formula (1).

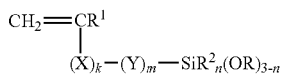

$$CH_2{=}CR^1-(X)_k-(Y)_m-SiR^2_n(OR)_{3-n} \quad (1)$$

wherein R represents a linear or branched alkyl group having 1 to 6 carbon atoms; $R^1$ represents a hydrogen atom or a methyl group; $R^2$ represents an alkyl group having 1 to 3 carbon atoms; X represents a phenylene group, —COO—, or —CONH—; Y represents a linear or branched alkylene group having 1 to 6 carbon atoms; each of k and m is 0 or 1, wherein a case where both k and m are 0 is excluded; and n is 0, 1 or 2.

When the vinyl resins are prepared, vinyl monomers having no alkyloxysilyl group can also be used in combination with the radically polymerizable monomers having an alkyloxysilyl group. Specific examples of such vinyl monomers include the following.

(1) Vinyl Hydrocarbons

Vinyl hydrocarbons include aliphatic vinyl hydrocarbons, alicyclic vinyl hydrocarbons, and aromatic vinyl hydrocarbons.

Specific examples of the aliphatic vinyl hydrocarbons include alkenes (e.g., ethylene, propylene, butene, isobtylene, pentene, heptene, diisobutylene, octene, dodecene, octadecene, and other α-olefins); and alkadienes (e.g., butadiene, isoprene, 1,4-pentadiene, 1,6-hexadiene, and 1,7-octadiene).

Specific examples of the alicyclic vinyl hydrocarbons include mono- or di-cycloalkens or alkadienes (e.g., cyclohexene, (di)cyclopentadiene, vinylcyclohexene, and ethylidenebicycloheptene); and terpens (e.g., pinene, limonene, and indene).

Specific examples of the aromatic vinyl hydrocarbons include styrene, hydrocarbyl derivatives (such as alkyl, cycloalkyl, aralkyl and/or alkenyl derivatives) of styrene, (e.g., α-methyl styrene, vinyl toluene, 2,4-dimethyl styrene, ethyl styrene, isopropyl styrene, butyl styrene, phenyl styrene, cyclohexyl styrene, benzyl styrene, crotyl benzene, divinyl benzene, divinyltoluene, divinylxylene, and trivinylbenzene) divinyl naphthalene, etc.

(2) Vinyl Monomers Having Carboxyl Group and their Salts

Suitable monomers for use as the vinyl monomers having a carboxyl group and their salts include unsaturated monocarboxylic acids having 3 to 30 carbon atoms, unsaturated dicarboxylic acids having 3 to 30 carbon atoms, and anhydrides and monoalkyl (having 1 to 24 carbon atoms) esters thereof. Specific examples thereof include (meth)acrylic acid, maleic acid (anhydride), monoalkyl maleate, fumaric acid, monoalkyl fumarate, crotonic acid, itaconic acid, monalkyl itaconate, glycol monoether of itaconic acid, citraconic acid, monoalkyl citraconate, cinnamic acid, etc.

(3) Vinyl Monomers Having Sulfonic Acid Group, Monoesters of Vinylsulfuric Acid, and Salts thereof Specific examples of the vinyl monomers having a sulfonic acid group include alkenesulfonic acids having 2 to 14 carbon atoms (e.g., vinyl sulfonic acid, (meth)acryl sulfonic acid, methylvinyl sulfonic acid, and styrene sulfonic acid) and their alkyl (having 2 to 24 carbon atoms) derivatives (e.g., α-methyl styrene sulfonic acid); sulfo(hydroxyl)alkyl(meth)acrylate or acrylamide (e.g., sulfopropyl(meth)acrylate, 2-hydroxy-3-(meth)acryloxypropyl sulfonic acid, 2-(meth) acryloylamino-2,2-dimethylethane sulfonic acid, 2-(meth) acryloyloxyethane sulfonic acid, 3-(meth)acryloyloxy-2-hydroxypropane sulfonic acid, 2-(meth)acrylamide-2-methylpropane sulfonic acid, and 3-(meth)acrylamide-2-hydroxypropane sulfonic acid, alkyl(C=3-18) arylsulfosuccinic acid); etc.

Specific examples of the monoesters of vinylsulfuric acid include sulfates of poly(n=2-30, single, random or block) oxyalkylene(ethylene, propylene and butylene) mono(meth) acrylates (e.g., sulfates of polyoxypropylene(n=5-15) monomethacrylate).

(4) Vinyl Monomers Having Phosphoric Acid Group and Salts thereof

Specific examples of the vinyl monomers having a phosphoric acid group include monoesters of (meth)acryloyloxyalkylphosphoric acid (e.g., 2-hydroxyethyl(meth)acryloylphosphate, and phenyl-2-acryloyloxyethylphosphate); acryloyloxyalkyl(C=1-24)phosphonic acid (e.g., 2-acryloyloxyethylphosphonic acid); etc.

In the above-mentioned monomers listed in paragraphs (2)-(4), specific examples of the salts thereof include alkali metal salts (e.g., sodium salts and potassium salts), alkali earth metal salts (e.g., calcium salts and magnesium salts), ammonium salts, amine salts, quaternary ammonium salts, etc.

(5) Monomers Having Hydroxyl Group

Specific examples of the monomers having a hydroxyl group include hydroxystyrene, N-methylol(meth)acrylamide, hydroxyethyl(meth)acrylate, hydroxypropyl(meth) acrylate, polyethylene glycol mono(meth)acrylate, (meth)allyl alcohol, crotyl alcohol, isocrotyl alcohol, 1-butene-3-ol, 2-butene-1-ol, 2-butene-1,4-diol, propagyl alcohol, 2-hydroxyethyl propenyl ether, sucrose allyl ether, etc.

(6) Nitrogen-Containing Vinyl Monomers

Suitable nitrogen-containing vinyl monomers include vinyl monomers having an amino group, an amide group, a nitrile group, a quaternary ammonium group or a nitro group.

Specific examples of the vinyl monomers having an amino group include aminoethyl(meth)acrylate, dimethylaminoethyl(meth)acrylate, diethylaminoethyl(meth)acrylate, t-butylaminoethyl(meth)acrylate, N-aminoethyl(meth)acrylamide, (meth)allyl amine, morpholinoethyl(meth)acrylate, 4-vinylpyridine, 2-vinylpyridine, crotyl amine, N,N-dimethylaminostyrene, methyl-α-acetoamino acrylate, vinyl imidazole, N-vinylpyrrole, N-vinylthiopyrrolidone, N-arylphenylenediamine, aminocarbazole, aminothiazole, aminoindole, aminopyrrole, aminoimidazole, aminomercaptothiazole, salts of these compounds, etc.

Specific examples of the vinyl monomers having an amide group include (meth)acrylamide, N-methyl(meth)acrylamide, N-butylacrylamide, diacetoneacrylamide, N-methylol (meth)acrylamide, N,N-methylene-bis(meth)acrylamide, cinnamide, N,N-dimethylacrylamide, N,N-dibenzylacrylamide, methacrylformaide, N-methyl-N-vinylacetamide, N-vinylpyrrolidone, etc.

Specific examples of the vinyl monomers having a nitrile group include (meth)acrylonitrile, cyanostyrene, cyanoacrylate, etc.

Specific examples of the vinyl monomers having a quaternary ammonium group include quaternary ammonium salts, which are prepared by reacting tertiary amines (such as dimethylaminoethyl(meth)acrylate, diethylaminoethyl(meth) acrylate, dimethylaminoethyl(meth)acrylamide, diethylaminoethyl(meth)acrylamide, and diallylamine) with an agent such as methyl chloride, dimethylsulfuric acid, benzyl chloride, and dimethyl carbonate).

Specific examples of the vinyl monomers having a nitro group include nitrostyrene, etc.

(7) Vinyl Monomers Having Epoxy Group

Specific examples of the vinyl monomers having an epoxy group include glycidyl (meth)acrylate, tetrahydrofurfryl (meth)acrylate, p-vinylphenyloxide, etc.

(8) Vinyl Esters, Vinyl (Thio)Ether, Vinyl Ketone, and Vinyl Sulfone

Specific examples of the vinyl esters include vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinylmethoxy acetate, vinyl benzoate, ethyl-α-ethoxy acrylate; alkyl(C=1-50) (meth)acrylate (e.g., methyl(meth)acrylate, ethyl(meth)acrylate, propyl(meth) acrylate, butyl(meth)acrylate, 2-ethylhexyl(meth)acrylate, dodecyl(meth)acrylate, hexadecyl(meth)acrylate, heptadecyl (meth)acrylate, and eicocyl(meth)acrylate); dialkyl fumarate in which each of the two alkyl groups is a linear, branched or alicyclic alkyl group having 2 to 8 carbon atoms; dialkyl maleate in which each of the two alkyl groups is a linear, branched or alicyclic alkyl group having 2 to 8 carbon atoms; poly(meth)allyloxyalkanes (e.g., diallyloxyethane, triallyloxyethane, tetraallyloxyethane, tetraallyloxypropane, tetraallyloxybutane, and tetramethallyloxyethane); vinyl monomers having a polyalkylene glycol chain (e.g., polyethylene glycol (molecular weight of 300) mono(meth)acrylate, polypropylene glycol (molecular weight of 500) mono(meth) acrylate, (meth)acrylates of ethylene oxide (10 mol) adducts of methanol, and (meth)acrylates of ethyleneoxide (30 mol) adducts of lauryl alcohol); (meth)acrylic esters of polyhydric alcohols (e.g., ethylene glycol di(meth)acrylate, propylene glycol di(meth)acrylate, neopentylglycol di(meth)acrylate, trimethylolpropane tri(meth)acrylate, polyethylene glycol di(meth)acrylate, etc.); etc.

Specific examples of the vinyl (thio) ethers include vinyl methyl ether, vinyl ethyl ether, vinyl propyl ether, vinyl butyl ether, 2-ethylhexyl vinyl ether, vinyl phenyl ether, 2-methoxyethyl vinyl ether, methoxybutadiene, 2-butoxyethyl vinyl ether, 3,4-dihydro-1,2-pyran, 2-butoxy-2'-vinyloxydiethyl ether, acetoxystyrene, phenoxystyrene, etc.

Specific examples of the vinyl ketones include vinyl methyl ketone, vinyl ethyl ketone, vinyl phenyl ketone, etc.

Specific examples of the vinyl sulfones include divinyl sulfide, p-vinyldiphenyl sulfide, vinyl ethyl sulfide, vinyl ethyl sulfone, divinyl sulfone, divinylsulfoxide, etc.

(9) Other Vinyl Monomers

Specific examples of other vinyl monomers include isocyanateethyl(meth)acrylate, m-isopropenyl-α,α-dimethylbenzylisocyanate, etc.

(10) Fluorine-Containing Vinyl Monomers

Specific examples of the fluorine-containing vinyl monomers include 4-fluorostyrene, 2,3,5,6-tetrafluorostyrene, pentafluorophenyl(meth)acrylate, pentafluorobenzyl(meth) acrylate, perfluorocyclohexyl(meth)acrylate, perfluorocyclohexylmethyl(meth)acrylate, 2,2,2-trifluoroethyl(meth) acrylate, 2,2,3,3-tetrafluoropropyl(meth)acrylate, 1H,1H, 4H-hexafluorobutyl(meth)acrylate, 1H,1H,5H-octafluoropentyl(meth)acrylate, 1H,1H,7H-dodecafluoroheptyl(meth)acrylate, perfluorooctyl(meth) acrylate, 2-perfluorooctylethyl(meth)acrylate, heptadecafluorodecyl(meth)acrylate, trihydroperfluoroundecyl(meth)acrylate, perfluoronorbornylmethyl(meth)acrylate, 1H-perfluoroisobornyl(meth)acrylate, 2-(N-butylperfluorooctanesulfonamide)ethyl(meth)acrylate, 2-(N-ethylperfluorooctanesulfonamide)ethyl(meth)acrylate, derivatives of α-fluoroacrylic acid, bis(hexafluoroisopropyl)itaconate, bis (hexafluoroisopropyl)maleate, bis(perfluorooctyl)itaconate, bis(perfluorooctyl)maleate, bis(trifluoroethyl)itaconate, bis (trifluoroethyl)maleate, vinylheptafluoro butyrate, vinylperfluoro heptanoate, vinylperfluoro nanote, vinylperfluoro octanoate, etc.

When the toner of the present invention is prepared, an aqueous dispersion of a vinyl resin including a unit obtained from a radically polymerizable monomer having an alkyloxysilyl group (i.e., a resin prepared using a radically polymerizable monomer having an alkyloxy silyl group) is preferably used. Such an aqueous resin dispersion can be prepared by known emulsion methods.

Polyester Resin

The toner of the present invention includes a polyester resin as well as a vinyl resin including a unit obtained from a radically polymerizable monomer having an alkyloxy silyl group. The polyester resin included in the toner of the present invention is not particularly limited, and any known polyester resins can be used alone or in combination. Suitable polyester resins include polycondensation products of a polyol (1) and a polycarboxylic acid (2).

Diols (1-1) and polyols (1-2) having 3 or more hydroxyl groups can be used as the polyol (1).

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F, bisphenol S, 4,4'-dihydroxybiphenyls (e.g., 3,3'-difluoro-4,4'-dihydroxybiphenyl), bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl) propane, 2,2-bis(3,5-difluoro-4-hydroxyphenyl)propane (i.e., tetrafluorobisphenol A), and 2,2-bis(3-hydroxyphenyl)-1,1,1,3,3,3-hexafluoropropane, and bis(4-hydroxyphenyl) ethers (e.g., bis(3-fluoro-4-hydroxyphenyl) ether)); adduct-softhealicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, alkylene oxide adducts of bisphenols, and mixtures of an alkylene oxide adduct of bisphenols with an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); alkylene oxide adducts of the polyphenols mentioned above; etc.

These diols and polyols can be used alone or in combination.

Dicaroxylic acids (2-1) and polycarboxylic acids (2-2) having 3 or more carboxyl groups can be used as the polycarboxylic acid (2).

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidenediphthalic anhydride); etc.

Among these compounds, alkenylene dicarboxylic acids having 4 to 20 carbon atoms and aromatic dicarboxylic acids having 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As for the polycarboxylic acid (2), anhydrides or lower alkyl esters (e.g., methyl esters, ethyl esters or isopropyl esters) of the polycarboxylic acids mentioned above can be used for the reaction with a polyol (1).

These dicarboxylic acids and polycarboxylic acids can be used alone or in combination.

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

The peak molecular weight of the polyester resin included in the toner of the present invention is preferably from 1,000 to 30,000, more preferably from 1,500 to 10,000, and even more preferably from 2,000 to 8,000. When the peak molecular weight is too low, the resultant toner has poor high temperature preservability. In contrast, when the peak molecular weight is too high, the resultant toner has a poor low temperature fixability.

It is preferable to use a crystalline polyester resin for the toner of the present invention. By using a crystalline polyester resin for the toner, a good combination of high temperature preservability and low temperature fixability can be imparted to the toner.

Hereinafter, crystalline polyesters will be explained. In this regard, the units of crystalline polyesters obtained from acid components are hereinafter referred to as acid-based units and the units obtained from alcohol components are hereinafter referred to as alcohol-based units.

In this application, crystalline polyester resins are defined as polyester resins having a property such that when the resins are subjected to differential scanning calorimetry (i.e., DSC), a clear endothermic peak is observed instead of a step-like endothermic change. When such crystalline polyester resins are used for toner, there is a case where the endothermic peak has a width of from 40 to 50° C. In this application, polyester copolymers including other polymer units in the main chain in an amount of not greater than 50% by weight belong in the category of crystalline polyester resins.

The crystalline polyester resin included in the toner preferably includes a unit having a sulfonic acid group. In this case, an electric double layer is formed by the sulfonic acid group, and thereby the polyester resin (i.e., polyester resin particles) can be stably dispersed in an aqueous medium. In addition, colorants, which are optionally used for the toner, can also be stably dispersed in an aqueous medium. Further, the polyester resin particles can be emulsified or suspended in an aqueous medium without using a surfactant. Therefore, when such an emulsion or suspension is used for preparing the toner, occurrence of a problem in that the resultant toner include coarse toner particles can be prevented.

The ratio of the unit having a sulfonic acid group to the total units constituting the crystalline polyester resin is preferably from 0.25 to 15% by mole, more preferably from 0.25 to 5% by mole, and even more preferably from 0.25 to 2% by mole. When the ratio is too high, the polyester resin has too high hydrophilicity, and thereby the charging properties of the toner are deteriorated particularly under high humidity conditions. In contrast, when the ratio is too low, an electric double layer cannot be stably formed, thereby causing a problem in that the resultant toner includes coarse toner particles.

In order to incorporate a unit having a sulfonic acid group in a polyester resin, dicarboxylic acids having a sulfonic acid group are preferably used, but diols having a sulfonic acid group can also be used alone or in combination with dicarboxylic acids having a sulfonic acid group. In any cases, it is preferable that the ratio of the unit or units obtained from such dicarboxylic acids and/or diols falls in the above-mentioned range.

Next, the acid-based unit of the crystalline polyester resins for use in the toner of the present invention will be explained.

Various dicarboxylic acids can be used for forming the acid-based unit. Among the dicarboxylic acids, aliphatic dicarboxylic acids are preferably used, and linear aliphatic dicarboxylic acids are more preferably used.

Specific examples of the aliphatic dicarboxylic acids include, but are not limited thereto, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters and anhydrides of these acids, etc. Among these acids, sebacic acid and 1,10-decanedicarboxylic acid are preferably used for reasons of availability.

Specific examples of aromatic dicarboxylic acids include terephthalic acid, isophthalic acid, orthophthalic acid, t-butylisophthalic acid, 2,6-naphtalenedicarboxylic acid, 4,4'-biphenyldicarboxylic acid, etc. Among these aromatic dicarboxylic acids, terephthalic acid, isophthalic acid, and t-butylisophthalic acid are preferably used because the acids are easily available and can form polymers, which can be easily emulsified.

Dicarboxylic acids (and alkyl esters and anhydrides thereof) having one or more double bonds can be used for forming the acid-based unit. When such dicarboxylic acids are used for preparing the polyester resin serving as a binder resin of the toner, the resin can be crosslinked, and thereby occurrence of a hot offset problem in that a toner image formed on a receiving material is adhered to a fixing member, resulting in formation of abnormal images or jamming of the receiving material can be prevented.

Specific examples of such dicarboxylic acids include fumaric acid, maleic acid, 3-hexenedioic acid, 3-octenedioic acid, and lower alkyl esters and anhydrides of the acids, but are not limited thereto. Among these acids, fumaric acid and maleic acid are preferably used in view of costs. The ratio of the unit obtained from a dicarboxylic acid having a double bond to the total acid-based units is preferably not greater than 20% by mole, and more preferably from 2 to 10% by mole. When the ratio is too high, the crystallinity of the polyester resin decreases, resulting in decrease of the melting point of the resin, and thereby the preservability of the toner image is deteriorated.

Dicarboxylic acids (and alkyl esters and anhydrides thereof) can also be used for forming the acid-based unit.

Specific examples of the above-mentioned dicarboxylic acids having a sulfonic acid group include sodium salt of 2-sulfoterephthalic acid, sodium salt of 5-sulfoisophthalic acid, and sodium salt of sulfosuccinic acid, but are not limited thereto. In addition, lower alkyl esters and anhydrides of dicarboxylic acids having a sulfonic acid group can also be used. Among these acids, sodium salt of 5-sulfoisophthalic acid is preferably used in view of costs.

When the acid-based unit having a sulfonic acid group is obtained only by one or more dicarboxylic acids having a sulfonic acid group, the ratio of the acid-based unit having a sulfonic acid group to the total acid-based units is preferably from 0.5 to 30% by mole, more preferably from 0.5 to 10% by mole, and even more preferably from 0.5 to 4% by mole.

Next, the alcohol-based unit of the crystalline polyester resins for use in the toner of the present invention will be explained.

Suitable alcohols for use in preparing the alcohol-based unit include aliphatic diols. Among the aliphatic diols, linear aliphatic diols having 7 to 20 carbon atoms are preferably used. When branched aliphatic diols are used, the crystallinity of the resultant polyester resins deteriorates, resulting in decrease of the melting point of the polyester resins. When such polyester resins are used for the toner, the high temperature preservability (i.e., resistance to blocking) and low temperature fixability of the toner and the preservability of fixed toner images deteriorate. When the number of carbon atoms in the aliphatic diols is too small, the resultant polyester resin has too high a melting point particularly when the aliphatic diols are reacted with aromatic dicarboxylic acids, resulting in deterioration of the low temperature fixability of the toner. Since aliphatic diols having a large number of carbon atoms (for example, 21 or more carbon atoms) cannot be easily obtained, the number of carbon atoms in the aliphatic diols is preferably not greater than 20, and more preferably not greater than 14.

When the polyester resin is prepared by reacting an aliphatic diol with an aromatic dicarboxylic acid, the number of carbon atoms of the main chain of the aliphatic diol is preferably odd. In this case, the melting point of the resultant polyester resin is lower than that in the case where the carbon number is even, and thereby the melting point of the polyester resin can be easily controlled in the below-mentioned preferable range.

Specific examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,2-eicosanediol, but are not limited thereto. Among these aliphatic dials, 1,8-octanediol, 1,9-nonanediol, and 1,10-decanediol are preferably used in view of availability, and 1,9-nonanediol is more preferably used because of having a relatively low melting point.

The ratio of the alcohol-based unit obtained from one or more aliphatic dials to the total alcohol-based units is preferably not less than 80% by mole, and more preferably not less than 90% by mole. When the ratio is too low, the crystallinity of the resultant polyester resin deteriorates, resulting in decrease of the melting point of the polyester resin, and thereby the high temperature preservability (resistance to blocking) and low temperature fixability of the toner and the preservability of fixed toner images are deteriorated.

The alcohol-based unit can include a unit obtained from a dial having a double bond and/or a unit obtained from a dial having a sulfonic acid group. Specific examples of the diols having a double bond include 2-butene-1,4-diol, 3-butene-1,6-diol, 4-butene-1,8-diol, etc. The ratio of the alcohol-based unit obtained from one or more diols having a double bond to the total alcohol-based units is preferably not greater than 20% by mole, and more preferably from 2 to 10% by mole. When the ratio is too high, the crystallinity of the polyester resin deteriorates, resulting in decrease of the melting point of the polyester resin, and thereby the preservability of the toner and fixed toner images is deteriorated.

Specific examples of the diols having a sulfonic acid group include sodium salt of 1,4-dihydroxy-2-sulfonylbenzene, sodium salt of 1,3-dihydroxymethyl-5-sulfonylbenzene, sodium salt of 2-sulfo-1,4-butanediol, etc.

When the alcohol-based unit having a sulfonic acid group is obtained only by one or more diols having a sulfonic acid group, the ratio of the alcohol-based unit having a sulfonic acid group to the total alcohol-based units is preferably from 0.5 to 30% by mole, more preferably from 0.5 to 10% by mole, and even more preferably from 0.5 to 4% by mole.

When diols having a double bond and/or diols having a sulfonic acid group are used in combination with aliphatic diols, the ratio of the units obtained from the other diols to the total alcohol-based units is preferably 1 to 20% by mole, and more preferably from 2 to 10% by mole.

The polyester resin included in the toner of the present invention preferably has a melting point of from 60 to 120° C., and more preferably from 70 to 100° C. When the melting point is too low, problems in that the toner particles tend to aggregate in a developing device, resulting in formation of abnormal images, and the fixed toner images are stuck to another copy sheet (resulting in occurrence of blocking) occur. In contrast, when the melting point is too high, the low temperature fixability of the toner deteriorates. In this application, the melting point of a resin is defined as the temperature corresponding to the top of an endothermic peak in a differential scanning calorimetry (DSC) curve of the resin, which DSC curve is obtained by subjecting the resin to DSC in a temperature range of from room temperature to 150° C. and at a temperature rising speed of 10° C./min.

The method for preparing the polyester resin used for the toner of the present invention is not particularly limited, and known polyester preparation methods such that an acid component is reacted with an alcohol component can be used. For example, direct polycondensation methods or ester exchange methods are used depending on the properties of the monomers used. The molar ratio of the acid components to the alcohol components is generally about 1/1, which changes depending on the reaction conditions.

The polymerization reaction for preparing the polyester resin is typically performed at a temperature of from 180 to 230° C. while the pressure of the reaction system is reduced, if necessary, to remove water and alcohols produced by the reaction.

When the monomers used are not mixed, solvents with a high boiling point are preferably used to dissolve the monomers therein. In this case, the polymerization reaction is performed while removing the solvent used. When a monomer having poor solubility is used, it is preferable that the monomer is previously subjected to a condensation reaction with an acid or alcohol component to be used for the polycondensation reaction, and the condensation product is then subjected to the polycondensation reaction with main monomers.

One or more catalysts can be used for the polycondensation reaction. Specific examples of the catalysts include compounds of alkali metals such as sodium and lithium; compounds of alkali earth metals such as magnesium and calcium; compounds of metals such as zinc, manganese, antimony, titanium, tin, zirconium, and germanium; phosphites, phosphates, and amines. Specific examples of the materials for use as the catalyst include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, tibutyl tin oxide, diphenyl tin oxide, zirconium tetrabutoxide, zirconium naththenate, zirconyl carbonate, zirconyl acetate, zirconyl stearate, zirconyl octylate, germanium oxide, triphenyl phosphite, tris(2,4-di-t-butylphenyl)phosphite, ethyltriphenylphosphonium bromide, triethyl amine, triphenyl amine, etc.

Colorant

The toner of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Wax

The toner of the present invention preferably includes a wax.

Known waxes can be used for the toner of the present invention. Specific examples of the waxes include polyolefin waxes such as polyethylene waxes and polypropylene waxes; hydrocarbons having a long chain such as paraffin waxes and SASOL waxes; and waxes having a carbonyl group.

Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate) polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

In addition, waxes having a low polarity are preferably used for the toner of the present invention. Specific examples thereof include hydrocarbon waxes such as polyethylene waxes, polypropylene waxes, paraffin waxes, SASOL waxes, microcrystalline waxes, and FISCHER-TROPSCH waxes.

The added amount of a wax in the toner is from 3 to 15% by weight, preferably from 4 to 12 parts by weight, and more preferably from 5 to 10 parts by weight, per 100 parts by weight of the resin components included in the toner. When the added amount is too small, the release effect of the wax cannot be well produced, resulting deterioration of the offset resistance of the toner. When the added amount is too large, problems which occur are that the wax exudes from the toner particles due to the heat energy or mechanical energy applied to the toner in a developing device, and the exuded wax is affixed to a photoreceptor and/or a developer layer thickness controlling blade, resulting in formation of abnormal images. In addition, when images of such a toner are recorded on an overhead projection sheet (OHP sheet), a problem in that the exuded wax is spread around the toner images, resulting in formation of abnormal projection images occurs.

The wax included in the toner preferably has an endothermic peak in a temperature range of from 60 to 90° C., and preferably from 65 to 80° C., when the wax is subjected to differential scanning calorimetry (DSC). When the temperature of an endothermic peak is too low, the resultant toner has poor fluidity and high temperature preservability. In contrast, when the temperature is too high, the resultant toner has poor fixability. In addition, the half width of the endothermic peak is preferably not greater than 8° C., and more preferably not greater than 6° C. When the half width is too wide, the resultant toner has poor fluidity and high temperature preservability.

The toner of the present invention optionally includes a charge controlling agent. Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

External Additive

The toner can include an external additive to improve the fluidity, developability, and charge properties of the toner. Particulate inorganic and organic materials are typically used as the external additive. Among the particulate inorganic materials, particulate inorganic materials having a primary particle diameter of from 5 nm to 2 μm, and preferably from 5 nm to 500 nm, are typically used. The specific surface area of the particulate inorganic materials is preferably from 20 to 500 $m^2/g$ when measured by a BET method.

The content of the inorganic particulate material is preferably from 0.01% to 5.0% by weight, and more preferably from 0.01% to 2.0% by weight, based on the total weight of the toner.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, hydroxyapatite, etc.

Among the particulate organic materials, particles of polymers such as polystyrene, polymethacrylates, and polyacrylate copolymers, which are prepared by a polymerization method such as soap-free emulsion polymerization methods, suspension polymerization methods and dispersion polymerization methods; particles of polymers such as silicone, benzoguanamine and nylon, which are prepared by a polymerization method such as polycondensation methods; and particles of thermosetting resins, can be preferably used as the external additive of the toner of the present invention.

The external additive used for the toner is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylating agents, silane coupling agents having a fluorinated alkyl group, organic titanate coupling agents, aluminum coupling agents, silicone oils, modified silicone oils, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethyl methacrylate and polystyrene, which are manufactured by a method such as soap-free emulsion polymerization methods. When particulate resins are used as the cleanability improving agent, it is preferably for the particulate resins to have a relatively narrow particle diameter distribution and a volume average particle diameter of from 0.01 μm to 1 μm.

Next, the image forming apparatus and process cartridge of the present invention will be explained.

The image forming apparatus of the present invention forms images using the toner of the present invention. The image forming apparatus can use a one-component developer which consists essentially of the toner of the present invention or a two-component developer which includes the toner of the present invention and a carrier, but a one-component developer is preferably used. In addition, the image forming apparatus preferably includes an endless intermediate transfer medium. Further, the image forming apparatus preferably includes a photoreceptor, and one or more cleaning devices for cleaning the photoreceptor and/or the intermediate transfer medium, which preferably include a cleaning blade. In addition, the image forming apparatus preferably includes a fixing device including, as a fixing member, a roller having a heat source therein or a combination of a belt and a heat source. It is preferable for the fixing device not to have an oil applicator which applies an oil to the fixing member to well release toner images from the fixing member. Further, the image forming apparatus can optionally include other devices such as discharging devices configured to discharge residual charges remaining on the photoreceptor, toner recycling devices configured to collect residual toner and feed the collected toner to the developing device, and controllers configured to control various image forming operations.

The image forming apparatus can include a process cartridge in which at least a photoreceptor, and a developing device configured to develop an electrostatic image with the toner to form a toner image on the photoreceptor are unitized and which can be detachably attached to the image forming apparatus using a guide such as rails and the like. The process cartridge can optionally include other devices such as charging devices configured to charge the photoreceptor, light irradiating devices configured to irradiate the photoreceptor to form an electrostatic image thereon, transfer devices configured to transfer the toner image to a receiving material via an intermediate transfer medium, separation devices configured to separate the receiving material from the photoreceptor or the intermediate transfer medium, and cleaning devices configured to clean the surface of the image bearing members such as photoreceptors and intermediate transfer media.

FIG. 1 is a schematic view illustrating an example of the image forming apparatus of the present invention.

Referring to FIG. 1, the image forming apparatus includes an image bearing member 1 (such as photoreceptors), which can bear an electrostatic latent image thereon and which is set in a main body (not shown) and is clockwise rotated. Around the image bearing member 1, a charging device 2, a light irradiating device 3, a developing device 4, a cleaning device 7, an intermediate transfer medium 8, which is rotated by two support rollers 10, a transfer roller 11, a discharger (not shown), etc., are arranged.

The image forming apparatus has a cassette (not shown) containing plural sheets of a receiving material 9 therein. The receiving material sheets are fed one by one by a feed roller (not shown). Each of the thus fed sheets is stopped once by a pair of registration rollers (not shown), and is then timely fed by the registration rollers to a transfer nip formed between the transfer roller 11 and the intermediate transfer medium 8.

The image forming operation of the image forming apparatus will be explained by reference to FIG. 1.

The image bearing member 1 is charged by the charging device 2 while clockwise rotated, and is then exposed to laser light which is emitted by the light irradiating device 3 and which is modulated according to the image information to be reproduced, resulting in formation of an electrostatic image on the image bearing member 1. The electrostatic image is developed by the developing device 4 using a developer including at least the toner of the present invention, resulting information of a toner image on the image bearing member 1. The toner image is then transferred onto the intermediate transfer medium 8 while a transfer bias is applied to the intermediate transfer medium 8. The toner image on the intermediate transfer medium 8 is then transferred by the transfer roller 11 onto the receiving material 9 fed to the transfer nip formed. The receiving material 9 bearing the toner image is then fed to a fixing device (not shown) to fix the toner image to the receiving material 9.

The fixing device includes a fixing roller which is heated by an internal heater to the predetermined temperature, and a pressure roller which is pressed to the fixing roller at the predetermined pressure. The receiving material 9 bearing the toner image is heated and pressed by the fixing roller and pressure roller, resulting in fixation of the toner image on the receiving material 9. The receiving material 9 bearing the fixed toner image (i.e., a copy sheet) is then discharged to a receiving tray (not shown).

On the other hand, the image bearing member 1, which has transferred the toner images thereon to the receiving material 9, is further rotated, and toner particles remaining on the surface of the image bearing member 1 without being transferred are removed therefrom by the cleaning device 7. Next, charges remaining on the image bearing member 1 are discharged by a discharger (not shown). The image bearing member 1 is then charged again with the charging device 2 to perform the next image forming operation. Thus, the image forming operation is repeated when producing plural images.

Next, the members and devices of the image forming apparatus will be explained in detail.

Specific examples of the image bearing member 1 include photoreceptors. The constitutional materials, shape, structure, size, etc. of the image bearing member 1 (photoreceptor) are not particularly limited. Regarding the shape, drum or endless photoreceptors are preferably used. Suitable materials for use in the photoreceptor include inorganic photosensitive materials such as amorphous silicon and selenium and organic materials such as polysilane and phthalopolymethine. Among these photosensitive materials, amorphous silicon and organic photosensitive materials are preferably used in view of life.

When an electrostatic image is formed on the surface of the image bearing member 1 (hereinafter referred to as the photoreceptor), the surface of the photoreceptor 1 is charged and is then exposed to image wise light. This latent image forming operation is performed by, for example, a combination of a charging device and a light irradiating device.

The charging process is performed by applying a voltage to the surface of the photoreceptor 1 using a charging device. The charging device is not particularly limited, and any known charging devices can be used therefor. Specific examples of the charging devices include contact charging devices having a conductive or semiconductive charging member such as rollers, brushes, films and rubber blades; noncontact charging devices such as corotrons and scorotrons, which utilize corona discharging.

Regarding the shape of the charging device, not only roller-form chargers but also brush-form chargers such as magnetic brush chargers and fur brush chargers can be used. The shape of the charging device is preferably determined depending on the specification and shape of the image forming apparatus for which the charging device is used.

Specific examples of the magnetic brush chargers include chargers including a charging member such as particulate ferrites (e.g., Zn—Cu ferrites), a nonmagnetic electroconductive sleeve configured to support the charging member, and a magnetic roller which is located in the sleeve and which forms a magnetic brush of the charging member on the sleeve.

Specific examples of the fur brush chargers include a support made of a metal or a material subjected to an electroconductive treatment, and fur which is subjected to an electroconductive material such as carbon, copper sulfide, metal and metal oxides and which is affixed to or wound around the surface of the support.

The charging device is not limited to such contact chargers, but it is preferable to use a contact charger, because the amount of ozone generated by the charging device can be reduced.

The light irradiation process is performed by irradiating the photoreceptor 1 with imagewise light using a light irradiation device. The light irradiation device is not particularly limited as long as the light irradiation device can form an electrostatic image on the charged surface of a photoreceptor, and a suitable light irradiating device is selected from known light irradiating devices for use in the image forming apparatus. Specific examples of the light irradiating device include optical devices for use in copiers, optical devices using a rod lens array, a laser or a liquid shutter, etc.

The development process is performed by developing the electrostatic image formed on the photoreceptor 1 with a developing device using a developer including the toner of the present invention. The developing device is not particularly limited, and any known developing devices can be used as long as the devices can develop electrostatic images using a developer including the toner of the present invention. For example, developing devices which can supply the toner of the present invention in a contact or noncontact manner to electrostatic images formed on the photoreceptor 1 can be used as the developing device. Suitable devices for use as the developing device include developing devices having a developing roller which bears a developer including the toner and which rotates while contacting the photoreceptor to supply the toner to electrostatic images formed on the photoreceptor to form toner images thereon, and a developer layer forming member which forms a thin layer of the developer including the toner on the surface of the developing roller.

The developing device may be a dry developing device or a wet developing device, and a monochrome developing device or a multi-color developing device. Suitable devices for use as the developing device include developing devices having an agitator configured to agitate a developer including the toner, and a rotatable magnet roller configured to bear the developer.

Metal rollers and elastic rollers are preferably used for the developing roller. Suitable metal rollers include rollers made of a metal such as aluminum. The surface of such metal rollers is preferably subjected to a blasting treatment so as to have a proper roughness. Specifically, by subjecting an aluminum roller to a glass-bead blasting treatment, the surface of the aluminum roller is roughened, and thereby a proper amount of toner can be borne on the surface of the aluminum roller.

Suitable elastic rollers include rollers covered with an elastic rubber layer. It is preferable to form an outermost layer, which is made of a material capable of having a charge with a polarity opposite to that of the toner, on the surface of the rubber layer. The elastic rubber layer preferably has a JIS-A hardness of not greater than 60° so that the toner on the developing roller is not deteriorated by the pressure applied by the developer layer forming member at the contact point (nip) between the developer layer forming member and the developing roller. The surface of the elastic rollers preferably has an Arithmetical Mean Deviation of the Profile (Ra) of from 0.3 to 2.0 μm to bear a proper amount of toner. In addition, since a developing bias is applied to the developing roller, the elastic rubber layer preferably has a resistance of from $10^3$ to $10^{10}\Omega$ to form a proper electric field between the developing roller and the photoreceptor. In FIG. 1, a developing roller 40 is rotated counterclockwise while bearing a developer 44 including the toner to transport the developer to the developing region at which the developing roller 40 faces the photoreceptor 1.

As illustrated in FIG. 1, a developer layer forming member 43 is set at a location higher than the nip between the developing roller 40 and a developer supplying roller 41. For example, the developer layer forming member 43 is a plate spring made of a metal such as stainless steel and phosphor bronze. The free end portion of the plate spring is pressed to the surface of the developing roller 40 at a pressure of from 10 to 40 N/m to form a thin developer layer on the surface of the developing roller while frictionally charging the toner included in the developer layer. In addition, a bias having the same polarity as that of the charge of the toner is applied to the developer layer forming member 43 to assist frictional charging of the toner.

Specific examples of the materials for use in the elastic rubber layer include styrene-butadiene rubbers, acrylonitrile-butadiene rubbers, acrylic rubbers, epichlorohydrin rubbers, urethane rubbers, silicone rubbers, mixtures of these rubbers, etc. Among these rubbers, mixtures of an epichlorohydrin rubber and an acrylonitrile-butadiene rubber are preferably used.

Such elastic rubber developing rollers can be prepared by covering the peripheral surface of an electroconductive shaft (e.g., shafts of a metal such as stainless steel) with such an elastic rubber material.

The transfer process is performed by, for example, transferring a toner image formed on the photoreceptor 1 using a transfer device while charging the photoreceptor. It is preferable for the transfer device to have a primary transfer device configured to transfer a toner image on the photoreceptor 1 to an intermediate transfer medium, and a secondary transfer device configured to transfer a toner image on the intermediate transfer medium to a receiving material. It is more preferable for the transfer device to have a primary transfer device configured to transfer two or more color images (preferably four color images for forming a full color image) to an intermediate transfer medium to form a combined color toner image thereon, and a secondary transfer device configured to transfer the combined color toner image onto a receiving material.

The intermediate transfer medium 8 is not particularly limited, and any known intermediate materials such as transfer belts can be used.

The transfer device preferably has a transfer member which can charge toner images so as to be easily released from the surface of the photoreceptor or intermediate transfer medium. The transfer device can include one or more transfer members such as transfer members using corona discharging, transfer belts, transfer rollers, pressure transfer rollers, and adhesive transfer members.

Plain papers are typically used for the receiving material. However, the receiving material is not limited thereto, and any known materials can be used therefor. For example, plastic films such as polyethylene terephthalate films can also be used as receiving materials for overhead projection (OHP) use.

The fixing process is performed by fixing a toner image on a receiving material using a fixing device. When a multi-color image is prepared, it is possible to perform plural fixing operations when each of the plural color images constituting the multi-color image is transferred on a receiving material or to perform only one fixing operation on a combined color toner image (i.e., overlaid plural color toner images) formed on a receiving material.

Any known fixing devices can be used for the fixing process, but heat and pressure fixing devices are preferably used. Suitable heat and pressure fixing devices include devices having a heat roller and a pressure roller, and devices having a heat roller, a pressure roller and an endless belt. The temperature of the heating member such as heat rollers is preferably from 80 to 200° C.

Figure 2:
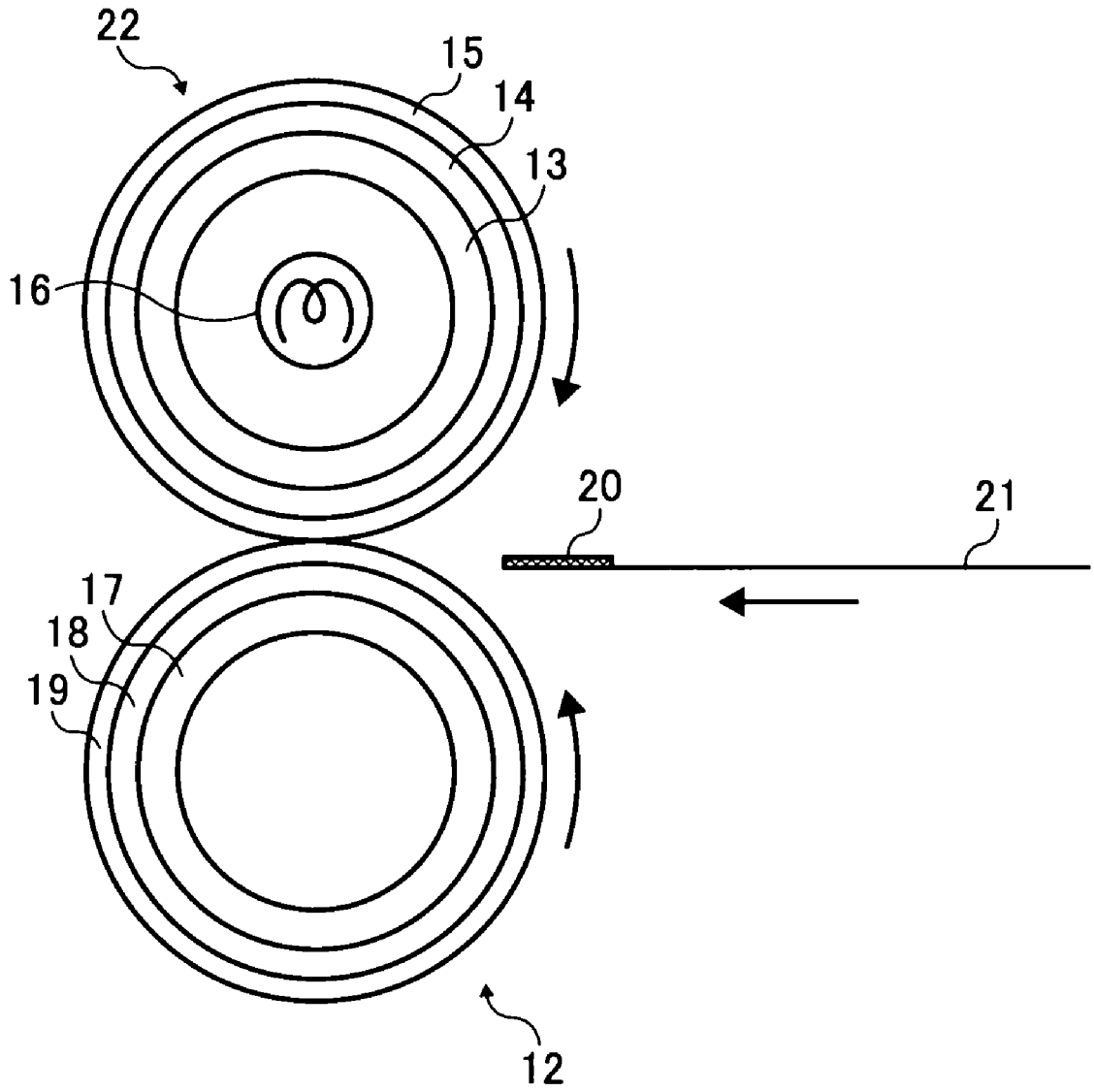
FIG. 2 is a schematic view illustrating a fixing device for use in the image forming apparatus of the present invention.

FIG. 2 illustrates a heat and pressure fixing device for use in the image forming apparatus of the present invention. The fixing device includes a heat roller 22, and a pressure roller 12. The heat roller 22 includes an aluminum cylinder 13, an elastic layer 14, an outermost layer made of a PFA (perfluoroethylene-perfluoroalkyl vinyl ether copolymer), and a heater 16. The heat roller 22 is rotated in a direction indicated by an arrow. The pressure roller 12 includes an aluminum cylinder 17, an elastic layer 18, and an outermost layer 19 made of a PFA. The pressure roller 12 is rotated in a direction indicated by an arrow. The heat roller 22 and pressure roller 12 heat and press a toner image 20 formed on a receiving material 21 to fix the toner image on the receiving material.

In the image forming apparatus of the present invention, light fixing devices can also be used alone or in combination with other fixing devices such as heat and pressure fixing devices.

In the discharging process, a bias is applied to the photoreceptor to discharge the charges remaining on the photoreceptor even after the transfer process. The discharging device is not particularly limited, and known dischargers such as discharging lamps can be used.

In the cleaning process, toner particles remaining on the photoreceptor are removed using a cleaner. Any known cleaners such as magnetic brush cleaners, electrostatic brush cleaners, magnetic roller cleaners, blade cleaners, brush cleaners, and web cleaners can be used as the cleaner of the cleaning device.

In the recycling process, the toner particles collected by the cleaning device are fed to the developing device by a recycling device. The recycling device is not particularly limited, and any known powder feeding devices can be used therefor.

In the controlling process, all the image forming processes are controlled using a controller. The controller is not particularly limited, and any known controllers such as sequencers and computers can be used.

The image forming method and apparatus, and process cartridge of the present invention can produce high quality images because of using the toner of the present invention, which has a good fixability and which hardly causes the cracking problem.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation Example of Colorant Dispersion (P)

The following components were mixed and the mixture was subjected to a dispersing treatment using a homogenizer (ULTRA-TURRAX from IKA Japan) and supersonic waves to prepare a colorant dispersion, a cyan pigment dispersion (P) having a central particle diameter of 150 nm.

| | |
|---|---|
| Cyan pigment<br>(C.I. Pigment Blue 15:3, i.e., copper phthalocyanine, from Dainippon Ink & Chemicals, Inc.) | 50 g |
| Anionic surfactant<br>(NEOGEN SC from Dai-ichi Kogyo Seiyaku Co., Ltd.) | 5 g |
| Ion exchange water | 145 g |

Preparation Example of Wax Dispersion (W)

The following components were mixed.

| | |
|---|---|
| Paraffin wax<br>(HNP-9 from Nippon Seiro Co., Ltd.) | 100 g |
| Anionic surfactant<br>(NEOGEN SC from Dai-ichi Kogyo Seiyaku Co., Ltd.) | 5 g |
| Ion exchange water | 295 g |

The mixture was heated to 97° C., and then subjected to a dispersing treatment using a dispersing machine ULTRA-TURRAX T50 from IKA Japan. The dispersion was further subjected to a dispersing treatment using a homogenizer (GOLIN HOMOGENIZER from MEIWAFORSIS CO., LTD.) under the following conditions.

Temperature: 105° C.

Pressure: 550 kg/cm$^2$

Number of repetitions of dispersing operations: 20 times

Thus, a wax dispersion (W) having a central particle diameter of 190 nm was prepared.

Preparation Example of Polyester Dispersion

Preparation of Noncrystalline Polyester Dispersion (A-1)

The following components were mixed in a 1-litter flask.

| | |
|---|---|
| Dimethyl terephthalate | 170 g |
| Dimethyl 5-sulfoisophthalate sodium salt | 40.1 g |
| Propylene glycol | 106.5 g |
| Dipropylene glycol | 53.6 g |
| Diethylene glycol | 21.2 g |
| Dibutyl tin oxide | 0.07 g |

The mixture was reacted for 5 hours at 170° C. under a nitrogen gas flow, followed by a condensation reaction at 220° C. under a reduced pressure. The condensation reaction was performed while checking the molecular weight of the reaction product, and was stopped when the weight average molecular weight (Mw) and number average molecular weight (Mn) were about 7000 and about 4000, respectively. Thus, a polyester resin (1) (noncrystalline polyester) was prepared. It was confirmed that the polyester resin (1) has a glass transition temperature (Tg) of 52° C. which is determined by differential scanning calorimetry (DSC).

Next, 40 g of the polyester resin (1) was mixed with 119.2 g of ion exchange water, and the mixture was heated to 90° C. The mixture was mixed with 5% ammonia water so as to have a pH of 7. Next, 0.8 g of a 10% aqueous solution of dodecylbenzene sulfonic acid was added thereto, and the mixture was agitated by a dispersing machine ULTRA-TURRAX T50 from IKA Japan, which was rotated at a revolution of 8000 rpm. Thus, a dispersion (A-1) of the noncrystalline polyester resin 1 having a central particle diameter of 260 nm was prepared.

Preparation of Crystalline Polyester Dispersion (A-2)

The following components were mixed in a 5-litter flask.

| | |
|---|---|
| Sebacic acid | 1982 g |
| Ethylene glycol | 1490 g |
| Dimethyl 5-sulfoisophthalate sodium salt | 59.2 g |
| Dibutyl tin oxide | 0.8 g |

The mixture was reacted for 5 hours at 170° C. under a nitrogen gas flow, followed by a condensation reaction at 220° C. under a reduced pressure. The condensation reaction was performed while checking the molecular weight of the reaction product, and was stopped when the weight average molecular weight (Mw) and number average molecular weight (Mn) were about 9600 and about 4400, respectively. Thus, a polyester resin (2) (crystalline) was prepared. It was confirmed that the polyester resin has a melting point (Tg) of 71° C. which is defined as the temperature at which the differential scanning calorimetry (DSC) curve has a peak top is observed.

Next, 40 g of the polyester resin (2) was mixed with 119.2 g of ion-exchange water, and the mixture was heated to 90° C. The mixture was mixed with 5% ammonia water so as to have a pH of 7. Next, 0.8 g of a 10% aqueous solution of dodecylbenzene sulfonic acid was added thereto, and the mixture was agitated by a dispersing machine ULTRA-TURRAX T50 from IKA Japan, which was rotated at a revolution of 8000 rpm. Thus, a dispersion (A-2) of the crystalline polyester resin 2 having a central particle diameter of 300 nm was prepared.

Preparation Examples of Vinyl Resin

Preparation of Vinyl Resin Dispersion B-1

The following components were mixed to prepare a monomer mixture.

| | |
|---|---|
| Styrene | 90 parts |
| Methacrylic acid | 20 parts |
| 3-Methacryloyloxypropyltrimethoxysilane | 90 parts |
| n-Octylmercaptane | 3.5 parts |

On the other hand, the following components were fed into a reaction vessel equipped with a condenser, an agitator and a nitrogen feed pipe.

| | |
|---|---|
| Sodium dodecylsulfate | 1.6 parts |
| Ion exchange water | 492 parts |

After the mixture was heated to 80° C., a solution in which 2.5 parts of potassium persulfate was dissolved in 100 parts of ion exchange water was added to the mixture and the mixture was agitated for 15 minutes.

The above-prepared monomer mixture was dropped into the mixture over 90 minutes. The mixture was heated for 60 minutes at 80° C., followed by cooling. Thus, a vinyl resin dispersion B-1 was prepared. It was confirmed that the vinyl resin has an average particle diameter of 65 nm in the dispersion.

Part of the dispersion was dried in a petri dish to obtain a solid of the vinyl resin dispersion B-1. It was confirmed that the solid vinyl resin has a number average molecular weight of 11,000, a weight average molecular weight of 18,000 and a glass transition temperature (Tg) of 60° C.

Preparation of Vinyl Resin Dispersion B-2

The following components were mixed to prepare a monomer mixture.

| | |
|---|---|
| Styrene | 60 parts |
| Butyl acrylate | 20 parts |
| Methacrylic acid | 20 parts |
| p-Styryltrimethoxysilane | 100 parts |
| n-Octylmercaptane | 3.5 parts |

On the other hand, the following components were fed into a reaction vessel equipped with a condenser, an agitator and a nitrogen feed pipe.

| | |
|---|---|
| Sodium dodecylsulfate | 1.6 parts |
| Ion exchange water | 492 parts |

After the mixture was heated to 80° C., a solution in which 2.5 parts of potassium persulfate was dissolved in 100 parts of ion exchange water was added to the mixture and the mixture was agitated for 15 minutes.

The above-prepared monomer mixture was dropped into the mixture over 90 minutes. The mixture was heated for 60 minutes at 80° C., followed by cooling. Thus, a vinyl resin dispersion B-2 was prepared. It was confirmed that the vinyl resin has an average particle diameter of 70 nm in the dispersion.

Part of the dispersion was dried in a petri dish to obtain a solid of the vinyl resin dispersion B-2. It was confirmed that the solid vinyl resin has a number average molecular weight of 9,000, a weight average molecular weight of 15,000 and a glass transition temperature (Tg) of 50° C.

Preparation of Vinyl Resin Dispersion B-3

The following components were mixed to prepare a monomer mixture.

| | |
|---|---|
| Styrene | 70 parts |
| Methacrylic acid | 30 parts |
| p-Styryltrimethoxysilane | 60 parts |
| 3-Methacryloyloxypropylmethyldimethoxysilane | 40 parts |
| n-Octylmercaptane | 3.5 parts |

On the other hand, the following components were fed into a reaction vessel equipped with a condenser, an agitator and a nitrogen feed pipe.

| | |
|---|---|
| Sodium dodecylsulfate | 1.6 parts |
| Ion exchange water | 492 parts |

After the mixture was heated to 80° C., a solution in which 2.5 parts of potassium persulfate was dissolved in 100 parts of ion exchange water was added to the mixture and the mixture was agitated for 15 minutes.

The above-prepared monomer mixture was dropped into the mixture over 90 minutes. The mixture was heated for 60 minutes at 80° C., followed by cooling. Thus, a vinyl resin dispersion B-3 was prepared. It was confirmed that the vinyl resin has an average particle diameter of 50 nm in the dispersion.

Part of the dispersion was dried in a petri dish to obtain a solid of the vinyl resin dispersion B-3. It was confirmed that the solid vinyl resin has a number average molecular weight of 10,000, a weight average molecular weight of 16,000 and a glass transition temperature (Tg) of 58° C.

Preparation of Vinyl Resin Dispersion B-4

The following components were mixed to prepare a monomer mixture.

| | |
|---|---|
| Styrene | 154 parts |
| Butyl acrylate | 30 parts |
| Methacrylic acid | 16 parts |
| n-Octylmercaptane | 3.4 parts |

On the other hand, the following components were fed into a reaction vessel equipped with a condenser, an agitator and a nitrogen feed pipe.

| | |
|---|---|
| Sodium dodecylsulfate | 1.2 parts |
| Ion exchange water | 492 parts |

After the mixture was heated to 80° C., a solution in which 2.5 parts of potassium persulfate was dissolved in 100 parts of ion exchange water was added to the mixture and the mixture was agitated for 15 minutes.

The above-prepared monomer mixture was dropped into the mixture over 90 minutes. The mixture was heated for 60 minutes at 80° C., followed by cooling. Thus, a vinyl resin dispersion B-4 was prepared. It was confirmed that the vinyl resin has an average particle diameter of 90 nm in the dispersion.

Part of the dispersion was dried in a petri dish to obtain a solid of the vinyl resin dispersion B-4. It was confirmed that the solid vinyl resin has a number average molecular weight of 13,000, a weight average molecular weight of 24,000 and a glass transition temperature (Tg) of 68° C.

Preparation of Vinyl Resin Dispersion B-5

The following components were mixed to prepare a monomer mixture.

| | |
|---|---|
| Styrene | 60 parts |
| Butyl acrylate | 20 parts |

-continued

| | |
|---|---|
| Methacrylic acid | 20 parts |
| Trimethylsilyl methacrylate | 100 parts |
| n-Octylmercaptane | 3.5 parts |

On the other hand, the following components were fed into a reaction vessel equipped with a condenser, an agitator and a nitrogen feed pipe.

| | |
|---|---|
| Sodium dodecylsulfate | 1.6 parts |
| Ion exchange water | 492 parts |

After the mixture was heated to 80° C., a solution in which 2.5 parts of potassium persulfate was dissolved in 100 parts of ion exchange water was added to the mixture and the mixture was agitated for 15 minutes.

The above-prepared monomer mixture was dropped into the mixture over 90 minutes. The mixture was heated for 60 minutes at 80° C., followed by cooling. Thus, a vinyl resin dispersion B-5 was prepared. It was confirmed that the vinyl resin has an average particle diameter of 65 nm in the dispersion.

Part of the dispersion was dried in a petri dish to obtain a solid of the vinyl resin dispersion B-5. It was confirmed that the solid vinyl resin has a number average molecular weight of 11,000, a weight average molecular weight of 18,000 and a glass transition temperature (Tg) of 60° C.

The monomers used for preparing the vinyl resin dispersions B-1 to B-5 are listed in Table 1.

TABLE 1

| Vinyl Resin | Added amount of monomers (parts by weight) | | | | | | |
|---|---|---|---|---|---|---|---|
| | | | | Monomer including silyl group | | | |
| Dispersion | Styrene | BA | MAA | S1 | S2 | S3 | S4 |
| B-1 | 90 | 0 | 20 | 90 | 0 | 0 | 0 |
| B-2 | 60 | 20 | 20 | 0 | 0 | 100 | 0 |
| B-3 | 70 | 0 | 30 | 0 | 40 | 60 | 0 |
| B-4 | 154 | 30 | 16 | 0 | 0 | 0 | 0 |
| B-5 | 60 | 20 | 20 | 0 | 0 | 0 | 100 |

BA: Butyl acrylate
MAA: Methacrylic acid
S1: 3-Methacryloyloxypropyltrimethoxysilane
S2: 3-Methacryloyloxypropylmethyldimethoxysilane
S3: p-Styryltrimethoxysilane
S4: trimethylsilyl methacrylate Toner Preparation Example 1

The components listed in Table 2 below were fed into a round stainless flask, and then mixed and dispersed by a homogenizer (ULTRATURRAX T50 from IKA Japan). The mixture was heated to 48° C. using an oil bath while agitated to form aggregated particles. When the average particle diameter of the aggregated particles become 5.7 μm, an aqueous solution of sodium hydroxide with a concentration of NaOH of 0.5 mol/l was added to control the pH of the dispersion at 6.0. Further the dispersion was heated to 94° C. while agitated. In this heating process, the pH of the dispersion changed from 6.0 to about 5.0. When the average circularity of the particles in the dispersion became 0.970, the dispersion was cooled, and filtered to obtain the particles. After the thus obtained particles were washed with ion exchange water, the particles were separated from water by suction filtering using a Nutsche-type filter. The thus obtained particles were dispersed again in 3 litter of ion exchange water heated to 40° C., followed by agitation for 15 minutes. After this washing operation was repeated 5 times, the particles were separated from water by suction filtering using a Nutsche-type filter. Further, the particles were dried by a vacuum drying method. Thus, toner particles 1 were prepared.

The volume average particle diameter (Dv) and the circularity of the toner particles 1 were 5.6 μm and 0.971, respectively. The method for determining the volume average particle diameter (Dv) is as follows.

The average particle diameter and particle diameter distribution of a toner can be measured by a method using an instrument COULTER COUNTER TAII or MULTISIZER II from Beckman Coulter Inc., an interface (manufactured by Nikka Giken) by which particle diameter distributions on number basis and volume basis can be output, and a personal computer PC9801 (manufactured by NEC Corp.).

Specifically, the procedure of the method for measuring the average particle diameter and particle diameter distribution of a toner is as follows.

(1) A surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Beckman Coulter Inc.;
(2) Two (2) to 20 mg of a sample to be measured is added into the mixture;
(3) The mixture is subjected to an ultrasonic dispersion treatment for about 1 to 3 minutes; and
(4) The volume average particle diameter distribution and number average particle diameter distribution of the sample are measured using the instrument in which the aperture is 100 μm.

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

In the present application, the circularity (C) of a toner is determined by the following method using a flow-type particle image analyzer FPIA-2100 from Sysmex Corp.

(1) at first 100 to 150 ml of water from which solid impurities have been removed is added to a container;
(2) then 0.1 to 0.5 ml of a surfactant serving as a dispersant is added thereto;
(3) further 0.1 to 9.5 g of a sample to be measured is added into the mixture;
(4) the mixture is subjected to an ultrasonic dispersion treatment for about 1 to 3 minutes to prepare a dispersion; and
(5) the concentration of the sample in the dispersion is controlled so as to be from 3000 to 10000 pieces/μl.

The suspension including toner particles to be measured is passed through a detection area formed on a plate in the measuring instrument; and the particles are optically detected by a CCD camera and then the shapes of the images of the particles are analyzed with an image analyzer.

The circularity of a particle is determined by the following equation:

$$\text{Circularity } (C) = Cs/Cp$$

wherein Cp represents the length of the circumference of the image of a particle and Cs represents the length of the circumference of a circle having the same area as that of the image of the particle.

Toner Preparation Examples 2 to 13

The procedure for preparation of the toner particles 1 in Toner Preparation Example 1 was repeated except that the formulation of the toner particles was changed as illustrated in Table 2. Thus, toner particles 2 to 13 were prepared. The volume average particle diameter (Dv) and circularity of each of the toner particles 2 to 13 are also shown in Table 2.

In this regard, toner particles 11 to 13 are comparative toner particles.

TABLE 2

| No. of Toner Particles | Formulation of toner particles (parts by weight) P | W | A A-1 | A-2 | B No. | Added amount | Properties of toner particles Dv (μm) | C |
|---|---|---|---|---|---|---|---|---|
| 1 | 5 | 5 | 50 | 0 | B-1 | 50 | 5.6 | 0.971 |
| 2 | 5 | 5 | 80 | 0 | B-1 | 20 | 5.7 | 0.970 |
| 3 | 5 | 3 | 20 | 30 | B-1 | 50 | 5.6 | 0.971 |
| 4 | 5 | 6 | 10 | 20 | B-1 | 70 | 5.6 | 0.971 |
| 5 | 5 | 5 | 0 | 50 | B-1 | 50 | 5.6 | 0.972 |
| 6 | 5 | 5 | 50 | 0 | B-2 | 50 | 5.6 | 0.972 |
| 7 | 5 | 5 | 50 | 0 | B-3 | 50 | 5.6 | 0.972 |
| 8 | 5 | 5 | 50 | 0 | B-4 | 10 | 5.7 | 0.970 |
| | | | | | B-1 | 40 | | |
| 9 | 5 | 5 | 50 | 0 | B-1 | 30 | 5.6 | 0.971 |
| | | | | | B-2 | 20 | | |
| 10 | 5 | 5 | 40 | 20 | B-1 | 20 | 5.6 | 0.972 |
| | | | | | B-3 | 20 | | |
| 11 (comp. ex.) | 5 | 5 | 50 | 0 | B-4 | 50 | 5.7 | 0.970 |
| 12 (comp. ex.) | 5 | 5 | 50 | 0 | B-5 | 50 | 5.7 | 0.970 |
| 13 (comp. ex.) | 5 | 5 | 80 | 0 | B-4 | 18 | 5.6 | 0.971 |
| | | | | | B-1 | 2 | | |

P: Colorant dispersion (pigment dispersion)
W: Wax dispersion
A: Polyester resin dispersion
B: Vinyl resin dispersion
Dv: Volume average particle diameter
C: Circularity Next, 100 parts of each of the toner particles 1 to 13 was mixed with 0.2 parts of a particulate forsterite having an average primary particle diameter of 80 nm and an average secondary particle diameter of 0.39 μm and 1.3 parts of a hydrophobized silica (RX-200 from Nippon Aerosil Co.) using a HENSCHEL MIXER mixer to prepare toners of the present invention 1 to 10, and toners 11 to 13, which are comparative toners.

The toners 1 to 13 were evaluated with respect to the following properties.

1. Fixing Property

Each toner is set in an image forming apparatus (IPSIO CX2500 from Ricoh Co., Ltd.) to prepare unfixed toner images which have a solid image having a width of 36 mm and a weight of 9 g/m$^2$ at a position 3 mm apart from the tip of an A4 size paper having a weight of 45 g/m$^2$. In this regard, the paper is fed such that the longitudinal direction of the paper sheet is parallel to the paper feeding direction, and the machine direction of the paper (i.e., paper manufacturing direction) is perpendicular to the paper feeding direction. The paper sheets bearing the unfixed toner images are passed one by one through the fixing device illustrated in FIG. 2 while changing the temperature of the heat roller so as to be from 130 to 190° C. at intervals of 10° C., to determine the separable/non-offset fixing temperature range of the toner in which the toner image can be well fixed without causing a non-separating problem in that the toner image is not well separated from the heat roller and an offset problem in that part of the toner image is adhered to the heat roller and the part of the toner image is transferred to another portion of the receiving sheet and/or the following receiving sheet. In this regard, the fixing speed is 120 mm/sec.

The fixing device having such a structure as illustrated in FIG. 2 is used. The fixing device is a soft roller type fixing device, and includes the heat roller 22 and the pressure roller 12, each having an outer diameter of 40 mm. The heat roller 22 includes the aluminum cylinder 13, the elastic layer 14 made of a silicone rubber and having a thickness of 1.5 mm, the outermost layer 15 made of a PFA, and the heater 16 located in the aluminum cylinder 13. The pressure roller 12 includes the aluminum cylinder 17, the elastic layer 18 made of a silicone rubber and having a thickness of 1.5 mm, the outermost layer 19 made of a PFA.

The fixing property of the toner is graded as follows.

○: The separable/non-offset fixing temperature range is not narrower than 50° C. (Good)

Δ: The separable/non-offset temperature range is not narrower than 30° C. and narrower than 50° C.

X: The separable/non-offset temperature range is narrower than 30° C. (Bad)

2. Contamination of Photoreceptor and Intermediate Transfer Medium by Toner

Each toner is set in an image forming apparatus (IPSIO CX2500 from Ricoh Co., Ltd.), and 2000 copies of an original image having an image/background area ratio of 6% are continuously produced under a normal environmental condition of 23° C. and 45% RH. After the running test, the photoreceptor and the intermediate transfer medium are visually observed to determine whether they are contaminated by the toner.

The contamination is graded as follows.

○: A film of the toner is not formed on the surface of each of the photoreceptor and the intermediate transfer medium. (Good)

Δ: A film of the toner is formed on the surface of the photoreceptor or the intermediate transfer medium, but no image problem is caused.

X: A film of the toner is formed on the surface of the photoreceptor and/or the intermediate transfer medium, and an image problem is caused. (Bad)

3. Resistance of Toner to Stress

Each toner is set in an image forming apparatus (IPSIO CX2500 from Ricoh Co., Ltd.), and 2000 copies of an original image having an image/background area ratio of 6% are produced under a normal environmental condition of 23° C. and 45% RH. After production of 50 copies, a white solid image is formed. In this white solid image production process, the image forming apparatus is suddenly stopped, and the toner present on the surface of the developing roller is sucked to measure the charge (Q1) of the toner using an electrometer. This white solid image is formed after production of 2000 copies to determine the charge (Q2) of the toner and to determine the difference |Q1−Q2|.

The resistance of the toners to stress is graded as follows.

○: The difference |Q1−Q2| is not greater than 10 μC/g. (Good)

Δ: The difference |Q1−Q2| is greater than 10 μC/g and not greater than 15 μC/g.

X: The difference |Q1−Q2| is greater than 15 μC/g. (Bad)

4. Background Development

Each toner is set in an image forming apparatus (IPSIO CX2500 from Ricoh Co., Ltd.), and 2000 copies of an original image having an image/background area ratio of 6% are produced under a normal environmental condition of 23° C. and 45% RH. After production of 2000 copies, a white solid image is formed. In this white solid image production process, the image forming apparatus is suddenly stopped, and the toner present on the surface of the photoreceptor, which surface is not cleaned by a cleaner, is adhered to an adhesive tape. The adhesive tape is attached to a white paper to visually determine the degree of the background development.

○: No background development. (Good)

Δ: There is slight background development, but it is still acceptable.

X: Serious background development. (Bad)

5. High Temperature Preservability

After each toner is preserved for 8 hours at 50° C., the toner is sieved for 2 minutes using a 42-mesh screen to determine the ratio of the weight of the toner remaining on the screen to the total weight of the toner subjected to the sieving operation.

The high temperature preservability is graded as follows.

◎: The weight ratio is less than 10%. (Excellent)

○: The weight ratio is not less than 10% and less than 20%.

Δ: The weight ratio is not less than 20% and less than 30%.

X: The weight ratio is not less than 30%. (Bad)

The evaluation results are shown in Table 3.

TABLE 3

| | Evaluation results | | | | |
|---|---|---|---|---|---|
| Toner | Fixing property | Contamination | Resistance to stress | Background development | High temp. preservability |
| 1 (example) | ○ | ○ | ○ | ○ | ◎ |
| 2 (example) | ○ | ○ | ○ | ○ | ◎ |
| 3 (example) | Δ | ○ | ○ | ○ | ◎ |
| 4 (example) | ○ | ○ | ○ | ○ | ◎ |
| 5 (example) | ○ | ○ | ○ | ○ | ◎ |
| 6 (example) | ○ | ○ | ○ | ○ | ◎ |
| 7 (example) | ○ | ○ | ○ | ○ | ◎ |
| 8 (example) | ○ | ○ | ○ | ○ | ◎ |
| 9 (example) | ○ | ○ | ○ | ○ | ◎ |
| 10 (example) | ○ | ○ | ○ | ○ | ◎ |

TABLE 3-continued

| Toner | Evaluation results | | | | |
|---|---|---|---|---|---|
| | Fixing property | Contamination | Resistance to stress | Background development | High temp. preservability |
| 11 (comp. example) | X | Δ | X | X | Δ |
| 12 (comp. example) | X | Δ | X | X | Δ |
| 13 (comp. example) | X | X | X | X | Δ |

It is clear from Table 3 that the toners of the present invention have a good combination of fixing property, resistance to stress, and high temperature preservability without contaminating the image bearing members.

This document claims priority and contains subject matter related to Japanese Patent Application No. 2007-058642, filed on Mar. 8, 2007, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising a binder resin including a polyester resin and a vinyl resin;

a wax; and a colorant, wherein the toner is prepared by an emulsion aggregation method, and wherein the vinyl resin is prepared by polymerizing at least one radically polymerizable monomer including a monomer having an alkyloxysilyl group and having the following formula (I):

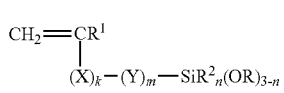

$$CH_2{=}CR^1-(X)_k-(Y)_m-SiR^2_n(OR)_{3-n} \quad (1)$$

wherein R represents a linear or branched alkyl group having 1 to 6 carbon atoms; $R^1$ represents a hydrogen atom or a methyl group; $R^2$ represents an alkyl group having 1 to 3 carbon atoms; X represents a phenylene group, —COO—, or —CONH—; Y represents a linear or branched alkylene group having 1 to 6 carbon atoms; each of k and m is 0 or 1, wherein a case where both k and m are 0 is excluded; and n is 0, 1 or 2, such that the toner contains the monomer having an alkyloxysilyl group in an amount of from 3% by weight to 30% by weight.

2. The toner according to claim 1, wherein in formula (1), X represents —COO—, R represents a linear alkyl group having 1 to 4 carbon atoms, and Y represents a linear alkylene group having 2 to 4 carbon atoms.

3. The toner according to claim 1, wherein the emulsion aggregation method comprises:

dispersing a dispersion of the polyester resin, a dispersion of the vinyl resin, a dispersion of the colorant, a dispersion of the wax in an aqueous medium including a surfactant to prepare an aqueous dispersion;

adding a flocculant to the aqueous dispersion to prepare aggregated particles including the polyester resin, vinyl resin, wax and colorant; and heating the aggregated particles to fix the aggregated particles.

4. The toner according to claim 1, wherein the emulsion aggregation method comprises:

mixing an aqueous dispersion of the vinyl resin and wax, an aqueous dispersion of the polyester resin, and a dispersion of the colorant to prepare an aqueous dispersion;

adding a flocculant to the aqueous dispersion to prepare aggregated particles including the vinyl resin, wax, polyester resin and colorant; and heating the aggregated particles to fix the aggregated particles, and wherein the aqueous dispersion of the vinyl resin and wax is prepared by a method including:

dissolving the wax in the at least one vinyl monomer to prepare a solution;

dispersing the solution in an aqueous medium including a surfactant;

polymerizing the at least one vinyl monomer using a polymerization initiator.

5. The toner according to claim 1, wherein the emulsion aggregation method comprises:

mixing an aqueous resin dispersion of the vinyl resin and polyester resin, an aqueous dispersion of the wax, and a dispersion of the colorant to prepare an aqueous dispersion;

adding a flocculant to the aqueous dispersion to prepare aggregated particles including the vinyl resin, polyester resin, wax and colorant; and heating the aggregated particles to fix the aggregated particles, and wherein the aqueous resin dispersion of the vinyl resin and polyester resin is prepared by a method including:

dissolving the polyester resin in the at least one vinyl monomer to prepare a solution;

dispersing the solution in an aqueous medium including a surfactant;

polymerizing the at least one vinyl monomer using a polymerization initiator.

6. The toner according to claim 1, wherein the wax includes a hydrocarbon wax.

7. The toner according to claim 1, wherein the polyester resin includes a crystalline polyester resin.

8. The toner according to claim 1, further comprising:

a charge controlling agent.

9. An image forming apparatus, comprising:

an image bearing member configured to bear an electrostatic image thereon;

a developing device configured to develop the electrostatic image with a developer including the toner according to claim 1 to form a toner image on the image bearing member; and a transfer device configured to transfer the toner image onto a receiving material.

10. The image forming apparatus according to claim 9, wherein the developer is a one-component developer consisting essentially of the toner.

11. The image forming apparatus according to claim 9, wherein the image bearing member bears plural electrostatic images, and the developing device develops the plural electrostatic images with plural developers including different color toners to prepare plural color images, and wherein each of the plural developers includes the toner according to claim 1.

12. A process cartridge comprising:

an image bearing member configured to bear an electrostatic image thereon; and a developing device configured to develop the electrostatic image with a developer including the toner according to claim 1 to form a toner image on the image bearing member, wherein the process cartridge is detachably attached to an image forming apparatus as a unit.

13. The image forming apparatus according to claim 12, wherein the developer is a one-component developer consisting essentially of the toner.

14. The toner as claimed in claim 1, wherein the toner contains the monomer having an alkyloxysilyl group in an amount of from 3.27% by weight to 28.38% by weight.

* * * * *